US009308748B2

(12) United States Patent
Ishikawa et al.

(10) Patent No.: US 9,308,748 B2
(45) Date of Patent: Apr. 12, 2016

(54) TRANSPORTING APPARATUS AND RECORDING APPARATUS

(71) Applicant: SEIKO EPSON CORPORATION, Tokyo (JP)

(72) Inventors: Akira Ishikawa, Shiojiri (JP); Kenichi Miyazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/077,025

(22) Filed: Nov. 11, 2013

(65) Prior Publication Data

US 2014/0132689 A1 May 15, 2014

(30) Foreign Application Priority Data

Nov. 12, 2012 (JP) ..... 2012-248364

(51) Int. Cl.

| | |
|---|---|
| ***B41J 2/01*** | (2006.01) |
| ***B41J 29/38*** | (2006.01) |
| ***B65H 5/00*** | (2006.01) |
| ***B41J 11/00*** | (2006.01) |
| ***B41J 15/04*** | (2006.01) |
| ***B65H 23/04*** | (2006.01) |

(52) U.S. Cl.

CPC ..... *B41J 11/0005* (2013.01); *B41J 15/046* (2013.01); *B65H 23/04* (2013.01); *B65H 2404/5214* (2013.01); *B65H 2515/716* (2013.01); *B65H 2515/842* (2013.01); *B65H 2801/36* (2013.01)

(58) Field of Classification Search

CPC ..... B41J 11/00; B41J 11/0045; B41J 11/007; B41J 11/06; B41J 11/0005; B41J 13/103; B41J 15/042; B41J 15/046; B65H 5/36; B65H 2404/6111; B65H 2404/5214; B65H 23/04; B65H 2801/36; B65H 2515/716; B65H 2515/842

USPC ..... 347/104, 16, 101; 271/264

See application file for complete search history.

(56) References Cited

U.S. PATENT DOCUMENTS

| | | | | |
|---|---|---|---|---|
| 4,734,987 | A * | 4/1988 | Cleveland | 33/18.1 |
| 4,916,466 | A * | 4/1990 | Coste | 346/136 |
| 5,092,696 | A * | 3/1992 | Armiroli et al. | 400/611 |
| 6,270,215 | B1 * | 8/2001 | Miyasaka et al. | 347/104 |
| 6,752,553 | B2 * | 6/2004 | Fujioka | 400/642 |
| 7,470,018 | B2 * | 12/2008 | Miyazaki et al. | 347/104 |
| 7,628,482 | B2 * | 12/2009 | Izumi | 347/104 |
| 8,474,971 | B2 * | 7/2013 | Okazaki | 347/104 |
| 2012/0162334 | A1 | 6/2012 | Sasaki | |
| 2014/0111587 | A1 * | 4/2014 | Nakano et al. | 347/104 |

FOREIGN PATENT DOCUMENTS

| | | |
|---|---|---|
| JP | 2012-139822 | 7/2012 |

* cited by examiner

*Primary Examiner* — Jannelle M Lebron
(74) *Attorney, Agent, or Firm* — Workman Nydegger

(57) ABSTRACT

A transporting apparatus includes a pair of transport rollers that transport a medium along a transport path that extends in a transport direction, a medium supporting section that supports the medium at a portion downstream of the pair of transport rollers in the transport direction, a supporting projection that supports the medium at a portion downstream of the medium supporting section in the transport direction, the medium being supported at an upstream portion in the transport direction by the medium supporting section, and a guide portion that is arranged at a position downstream of the medium supporting section in the transport direction and upstream of the supporting projection in the transport direction, the guide portion forming a concavity in the transport path with respect to the medium supporting section and the supporting projection.

12 Claims, 3 Drawing Sheets

TRANSPORTING APPARATUS AND RECORDING APPARATUS

BACKGROUND

1. Technical Field

The present invention relates to a transporting apparatus that transports a medium and to a recording apparatus that is provided with the transporting apparatus.

2. Related Art

As an example of a recording apparatus, there is an ink jet printer that performs printing by ejecting ink onto a medium such as roll paper. Among such printers, there is a printer in which a support member and a heater are arranged along a transport path extending from a recording unit, which performs printing, to a point where the printed sheet (roll paper) is wound. The support member has a curved support surface that applies tension to the sheet. The heater heats and dries a printed surface of the sheet. Moreover, the support member contributes to transmitting the heat of the heater to the sheet and to stretching out wrinkles of the sheet to be wound (see JP-A-2012-139822, for example).

It is preferable that, not limited to when the sheet is heated by the heater and when the sheet is wound, the sheet be transported while an appropriate tension is applied thereto so as to prevent wrinkles from forming. However, when the sheet is guided with a curved support surface, the sheet comes into sliding contact with the support surface and is charged with static electricity. Accordingly, there are cases in which the sheet sticks to the support surface causing the transportation of the sheet to become slowed down. Moreover, when transportation of the sheet, whose transportation has slowed down, is continued, the sheet becomes deflected, becomes lifted up from the support surface, and comes into contact with the members arranged along the transport path; accordingly, there is a concern that the printing surface may become damaged.

The above problem is not limited to printers that perform printing by ejecting ink onto roll paper but is a problem that is generally common among transporting apparatuses that transport a medium and recording apparatuses that are provided with such a transporting apparatus.

SUMMARY

An advantage of some aspects of the invention is to provide a transporting apparatus and a recording apparatus that can suppress generation of static electricity while an appropriate tension is applied to the medium that is being transported.

Means for solving the above problem and its effects will be described below.

According to an aspect of the invention, a transporting apparatus includes a transporting unit that transports a medium along a transport path that extends in a transport direction; a medium supporting section that supports the medium at a portion downstream of the transporting unit in the transport direction; a supporting projection that supports the medium, which is supported by the medium supporting section at an upstream portion in the transport direction, at a portion downstream of the medium supporting section in the transport direction; and a guide portion that is arranged at a position downstream of the medium supporting section in the transport direction and upstream of the supporting projection in the transport direction, the guide portion forming a concavity in the transport path with respect to the medium supporting section and the supporting projection.

According to such a configuration, the guide portion is capable of guiding the leading edge of the medium, which is being transported by the transporting unit, in the transport direction from the medium supporting section side to the supporting projection side and, further, is capable of subsidiarily supporting the medium that has been deflected below the transport path. Since the guide portion forms a concavity with respect to the medium supporting section and the supporting projection, when the medium is supported by the medium supporting section and the supporting projection, contact between the guide portion and the medium is restrained. Moreover, the medium, whose upstream portion in the transport direction is supported by the medium supporting section, hangs down under its own weight at the upstream side or the downstream side of the supporting projection in the transport direction, and thus, an appropriate tension is applied to the medium. Accordingly, generation of static electricity can be suppressed while an appropriate tension is applied to the medium that is being transported.

In the transporting apparatus described above, the guide portion preferably includes a concavity that extends in a width direction that intersects the transport direction.

According to such a configuration, the portion of the medium, which is being transported along the transport path while being supported by the medium supporting section and the supporting projection, that is above the concavity parts from the guide portion. Accordingly, generation of static electricity, caused by continuous contact of the medium with the members that support the medium, can be suppressed.

In the transporting apparatus described above, the guide portion is preferably formed by two or more guiding surfaces consecutively aligned in the transport direction.

According to such a configuration, when the leading edge of the medium is transported toward the supporting projection from the medium supporting section, the two or more guiding surfaces that are consecutively aligned in the transport direction guide the leading edge, and thus, the medium is not easily caught by the guide portion. Furthermore, the configuration can be simplified by forming the guide portion with the guide surfaces that are consecutively aligned in the transport direction.

In the transporting apparatus described above, the supporting projection is preferably arranged below the medium supporting section.

According to such a configuration, since the transport path is formed with the supporting projection such that the transport path becomes lower towards the downstream side in the transport direction, the portion of the medium, which is supported by the supporting projection, that is downstream of the supporting projection in the transport direction hangs down under its own weight. Accordingly, an appropriate tension is applied to the medium.

In the transporting apparatus described above, a recording unit that performs recording on the medium is preferably arranged between the transporting unit and the guide portion in the transport direction.

According to such a configuration, the medium is supported by the supporting projection that is arranged downstream of the recording unit in the transport direction; accordingly, the wrinkles of the medium, on which printing has been carried out, can be stretched out.

In the transporting apparatus described above, an end portion of the medium supporting section downstream in the transport direction and the supporting projection are preferably arranged along an imaginary curve that has a center of curvature below the medium supporting section, and the guide portion is preferably arranged on the center of curvature side of the imaginary curve.

According to such a configuration, the medium supporting section and the supporting projection can form a transport path that extends along the imaginary curve that becomes lower towards the downstream side in the transport direction. Accordingly, a portion of the medium, which is supported by the supporting projection, downstream in the transport direction hangs down under its own weight such that an appropriate tension is applied to the medium. Furthermore, the medium can be made to adequately part from the transport path by arranging the guide portion on the center of curvature side of the imaginary curve. Accordingly, when the medium is deflected so as to hang down between the medium supporting section and the supporting projection, the guide portion can subsidiarily support the medium while guiding the medium towards the downstream side in the transport direction.

The transporting apparatus described above preferably further includes a winding unit that is arranged below the supporting projection and that winds the medium supported by the medium supporting section and the supporting projection.

According to such a configuration, the medium that is supported by the supporting projection hangs down under its own weight at a portion downstream in the transport direction, and thus, an appropriate tension is applied to the medium. Accordingly, the winding unit can wind the medium that is in a state in which the wrinkles are stretched out.

According to another aspect of the invention, a recording apparatus includes the transporting apparatus described above and a recording unit that performs recording on the medium that is being transported by the transporting apparatus.

According to such a configuration, similar effects to those of the transporting apparatus described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of a transporting apparatus and a recording apparatus will be described below with reference to the drawings.

Figure 1:
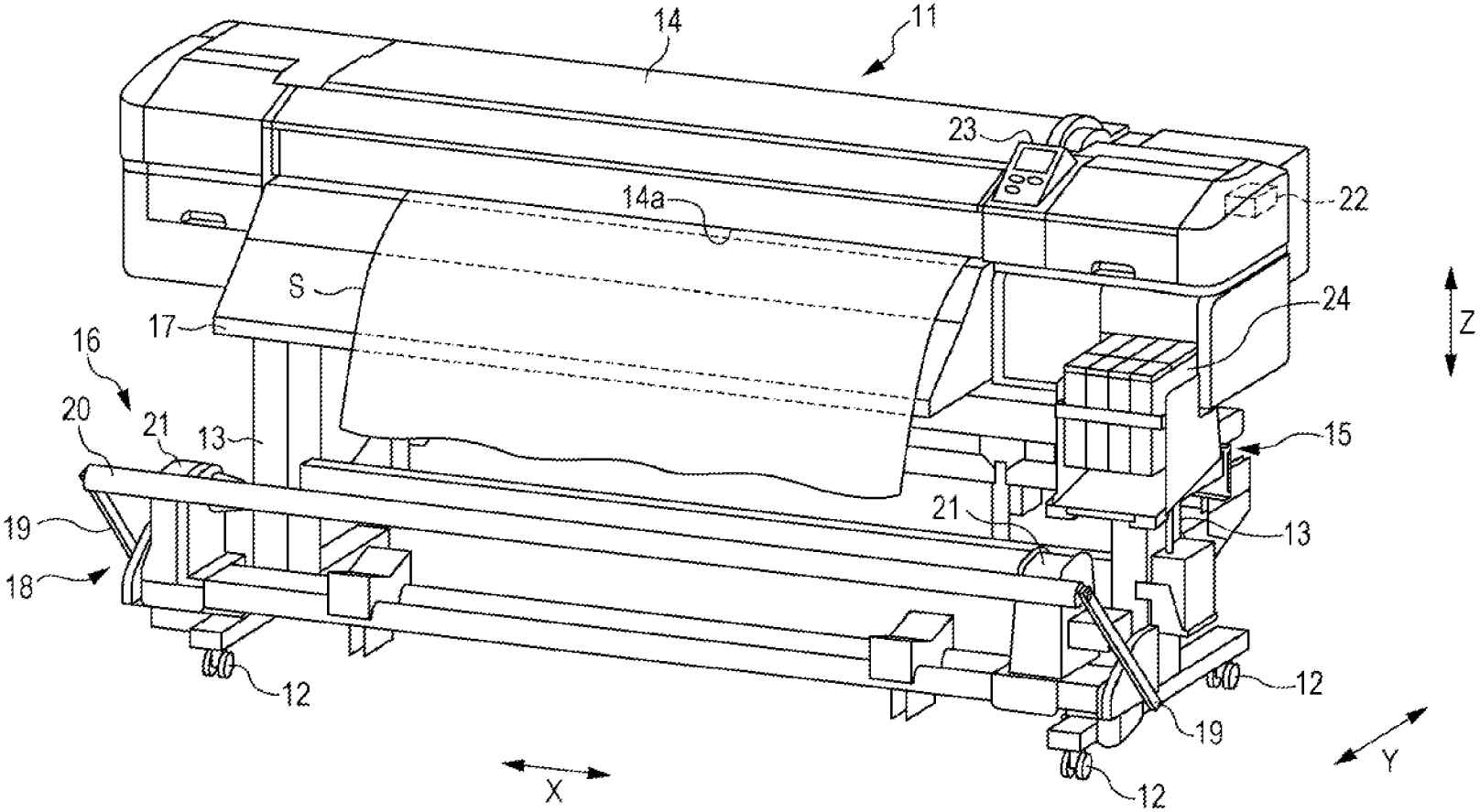
FIG. 1 is a perspective view of a recording apparatus of an exemplary embodiment.

As illustrated in FIG. 1, a recording apparatus 11 of the exemplary embodiment is a large format printer (LFP) that handles a long sheet (roll paper) S that is an example of a medium.

The recording apparatus 11 includes a pair of leg portions 13 that have wheels 12 attached thereto at the lower end of each leg portion 13 and a housing 14 mounted on the leg portions 13. Note that in the exemplary embodiment, a width direction X denotes a longitudinal direction of the housing 14 that intersects (orthogonal in the exemplary embodiment) an up-down direction Z extending in the direction of gravity. Furthermore, a front-rear direction Y denotes a direction that intersects (orthogonal in the exemplary embodiment) both the up-down direction Z and the width direction X.

A feeding unit 15 that feeds a sheet S towards the housing 14 side is arranged at a lower rear portion of the housing 14. Furthermore, a winding unit 16 that is supported by the leg portions 13 is arranged at a lower front portion of the housing 14. Moreover, a transport path forming unit 17 is arranged between the feeding unit 15 and the winding unit 16.

The rear end side of the transport path forming unit 17 is accommodated in the housing 14 and the front end side thereof protrudes forward from the housing 14. Furthermore, a discharge opening 14*a* that discharges the sheet S from inside the housing 14 is formed on the front side of the housing 14 at a position on the upper side of the transport path forming unit 17.

A tension applying mechanism 18 that applies tension to the sheet S, which is positioned between the transport path forming unit 17 and the winding unit 16, is provided in the vicinity of the winding unit 16. The tension applying mechanism 18 includes a pair of arm members 19 that are pivotally supported at the lower portions of the leg portions 13 and a tension roller 20 that is rotatably supported by the distal end portions of the pair of arm members 19.

The winding unit 16 includes a pair of holders 21 that hold therebetween a core material such as a paper tube (not shown), around which the printed sheet S is wound into a cylindrical shape, from both sides of the core material in the axial direction. One of the holders 21 (the holder 21 on the right side in FIG. 1) is rotated so that the sheet S is wound around the core material that is mounted between the pair of holders 21. The winding unit 16 of the exemplary embodiment adopts a spindle-less system that does not employ any spindle; however, a system employing a spindle may be used.

A control unit 22 that controls an operation of the recording apparatus 11 is provided in the housing 14. Furthermore, a control panel 23 for performing a setting operation and an input operation is provided at an upper portion and on one end side (right end side in FIG. 1) in the width direction X of the housing 14. The control panel 23 is electrically coupled to the control unit 22.

Liquid storage containers 24 that are each capable of storing ink, which is an example of the liquid, are provided at a lower portion of the housing 14 and on one end side (right end side in FIG. 1) that is an outer side of the transport path of the sheet S in the width direction X. The liquid storage containers 24 are provided in a plural number (four in the exemplary embodiment) so as to correspond to the types and colors of the inks.

Figure 2:
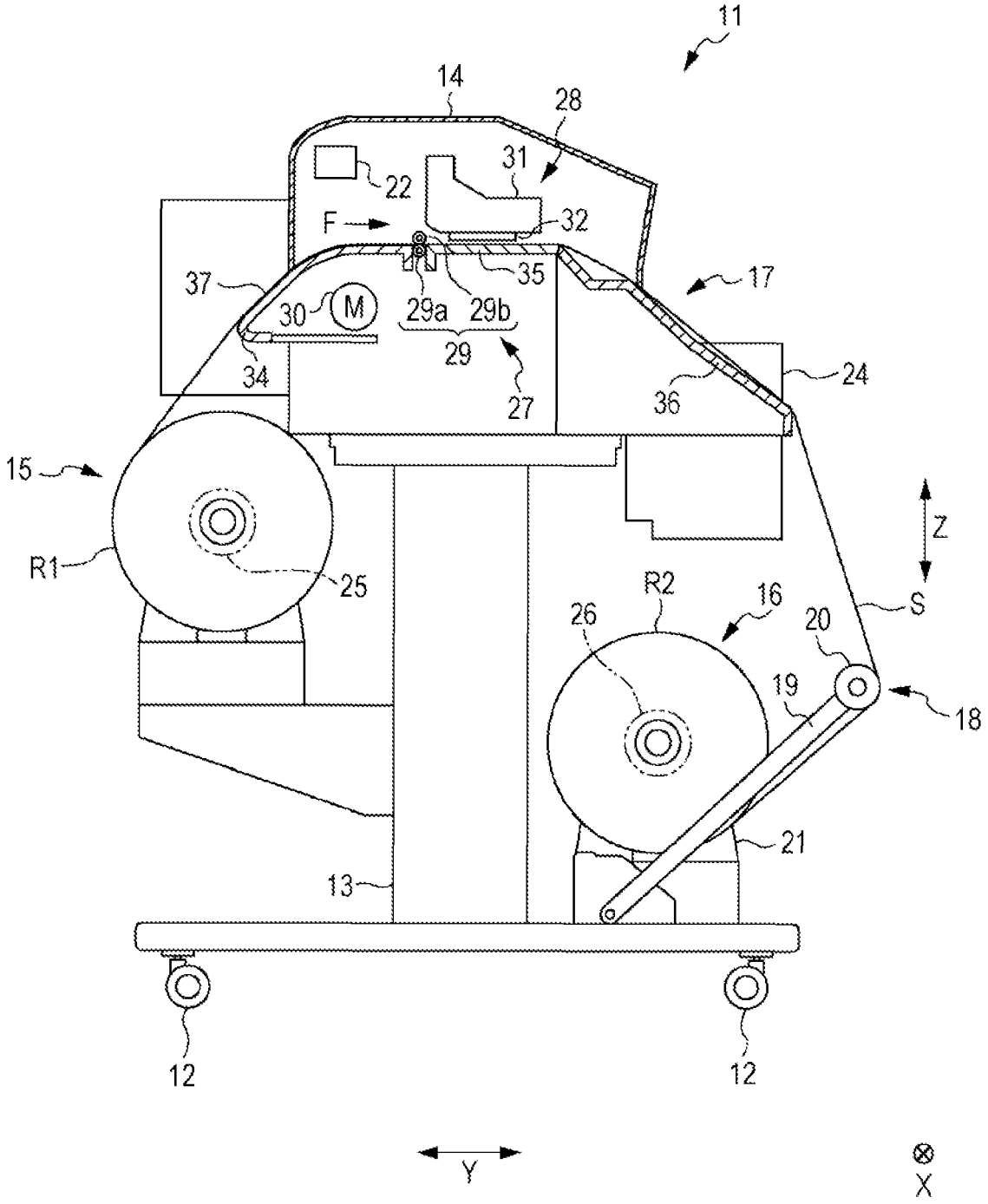
FIG. 2 is a cross-sectional view illustrating a schematic configuration of the recording apparatus.

As illustrated in FIG. 2, the feeding unit 15 holds therein a roll R1 that is an unused sheet S wound in a cylindrical shape. The feeding unit 15 further includes a feed motor 25 that outputs rotative power to one of a pair of holders (not shown) that hold therebetween the roll R1 in the axial direction. The rotation of the roll R1 in the clockwise direction in FIG. 2, which is in association with the driving of the feed motor 25, feeds the sheet S into the housing 14.

The winding unit 16 includes a winding motor 26 that outputs rotative power to one of the pair of holders 21 that hold a roll R2 in the axial direction. The rotation of the roll R2 in the clockwise direction in FIG. 2, which is in association with the driving of the winding motor 26, winds the sheet S onto the roll R2.

Some of the constituent elements of a transporting apparatus 27 that transports the sheet S and a recording unit 28 that performs recording (printing) on the sheet S that is being transported in a transport direction F by the transporting apparatus 27 are provided in the housing 14. The transporting apparatus 27 includes a pair of transport rollers 29 and a transport motor 30, which form an example of the transporting unit. The feeding unit 15, the winding unit 16, and the transport path forming unit 17 constitute the transporting apparatus 27.

The feed motor 25, the winding motor 26, and the transport motor 30 are electrically coupled to the control unit 22. Furthermore, the pair of transport rollers 29 include a driving roller 29*a* that is rotated by the driving force of the transport motor 30 and a driven roller 29*b* that pinches the sheet S between itself and the driving roller 29*a*.

The recording unit 28 includes a carriage 31 that reciprocates in a main scanning direction (the width direction X in the exemplary embodiment) that is orthogonal to the transport direction F of the sheet S and a liquid ejecting unit 32 that is held at the lower portion of the carriage 31. Furthermore, the liquid ejecting unit 32 ejects ink, which is supplied from the liquid storage container 24, onto the sheet S that is being transported by the transporting apparatus 27 along the transport path that extends in the transport direction F; accordingly, recording (printing) is performed.

The winding unit 16 is arranged at a position downstream of the transport path forming unit 17 in the transport direction and below the transport path forming unit 17. Furthermore, the printed sheet S that is supported by the transport path forming unit 17 is guided obliquely downward along the transport path forming unit 17 and is wound by the winding unit 16, such that the roll R2 is formed. At this time, the tension roller 20 applies tension to the sheet S that is to be wound by the winding unit 16 by pressing the back side of the sheet S, which is hanging down from the transport path forming unit 17 under its own weight.

A configuration of the transport path forming unit 17 will be described next in detail.

The transport path forming unit 17 includes a first support member 34 that is arranged upstream of the pair of transport rollers 29 in the transport direction F, a second support member 35 that is arranged downstream of the pair of transport rollers 29 in the transport direction F, and a third support member 36 that is arranged downstream of the second support member 35 in the transport direction F. The third support member 36 is formed by a plate-like member such as a metal plate that has been bent.

The first support member 34 is arranged at a position downstream of the feeding unit 15 in the transport direction and above the feeding unit 15. Furthermore, the first support member 34 includes a support surface 37 that is bent between the feeding unit 15 and the pair of transport rollers 29 such that the downstream side in the transporting direction is higher and such that tension is applied to the sheet S.

Figure 3:
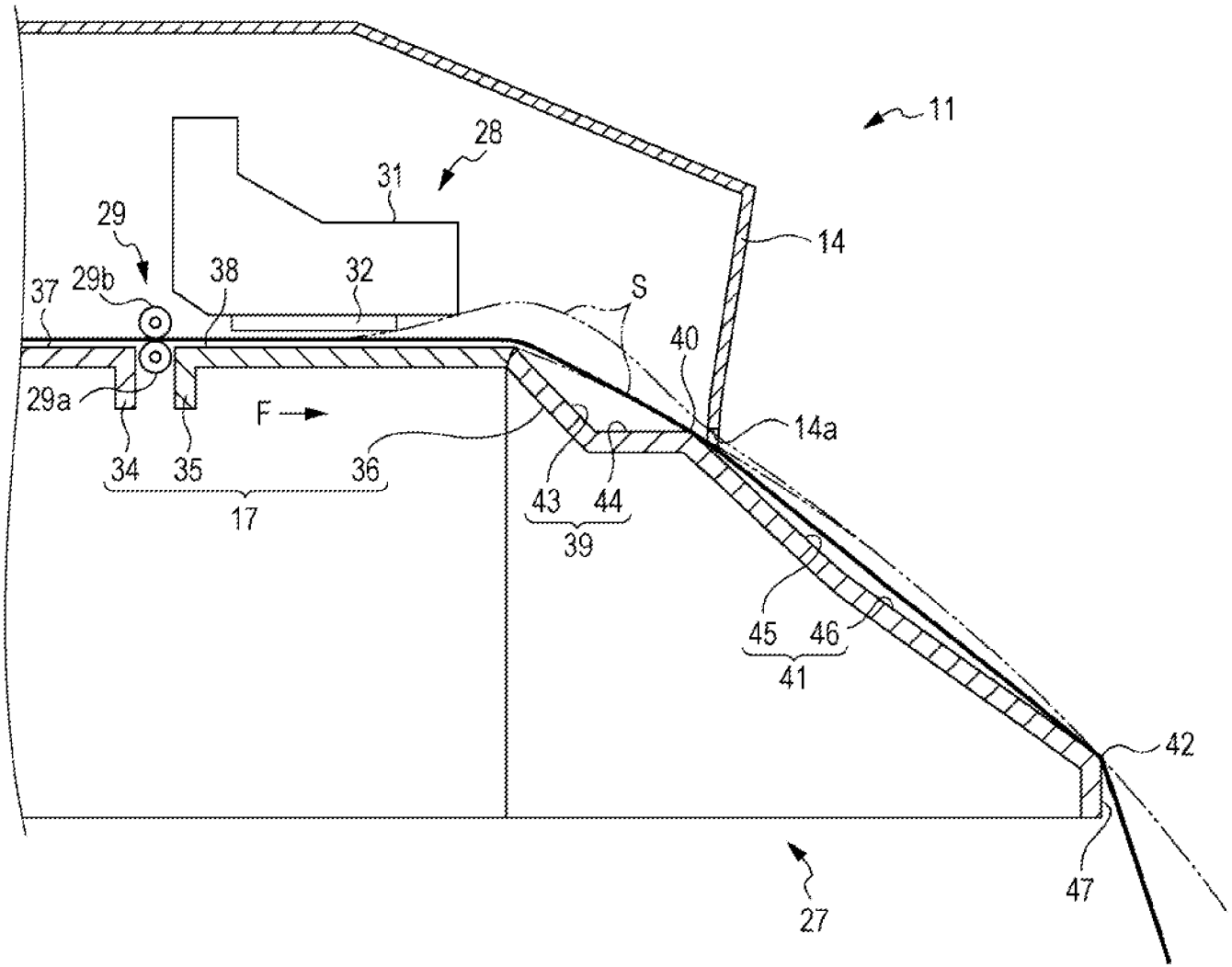
FIG. 3 is a cross-sectional view illustrating a configuration of a transport path forming unit.

As shown in FIG. 3, the second support member 35 is arranged at a position below the carriage 31 and opposite the liquid ejecting unit 32. Furthermore, the second support member 35 includes, at the downstream side of the pair of transport rollers 29 in the transport direction F, a medium supporting section 38 that supports the sheet S on which recording is carried out by the recording unit 28. In the exemplary embodiment, the medium supporting section 38 is formed on the upper surface side of the second support member 35.

The third support member 36 includes guiding surfaces 43, 44, 45, 46, and 47 that form a guide portion 39, a supporting projection 40, a guide portion 41, and a supporting projection 42 that are aligned from the upstream side to the downstream side in the transport direction F. In other words, the guide portion 39 is formed by two guiding surfaces 43 and 44 that are consecutively aligned in the transport direction F, and the guide portion 41 is formed by two guiding surfaces 45 and 46 that are consecutively aligned in the transport direction F. Furthermore, the supporting projection 40 is formed by two guiding surfaces 44 and 45 that are consecutively aligned in the transport direction F, and, further, the supporting projection 42 is formed by two guiding surfaces 46 and 47 that are consecutively aligned in the transport direction F.

In the exemplary embodiment, the medium supporting section 38 and the guiding surface 44 are formed so as to extend in a substantially horizontal direction, whereas the guiding surface 47 is formed so as to extend in a substantially vertical direction. Furthermore, each of the guiding surfaces 43, 45, and 46 is an inclined surface formed of a surface inclined such that the downstream side of each of the guiding surfaces 43, 45, and 46 in the transport direction becomes lower.

An end portion of the medium supporting section 38 downstream in the transport direction F and the apexes of the supporting projections 40 and 42 are arranged along an imaginary curve, as illustrated by a dot and dash line in FIG. 3, that has a center of curvature below the medium supporting section 38 and the supporting projections 40 and 42. Furthermore, the supporting projection 40 is arranged below the medium supporting section 38, and the supporting projection 42 is arranged below the supporting projection 40. Furthermore, the supporting projection 40 is arranged at a position slightly inside the housing 14 with respect to the discharge opening 14*a* of the housing 14.

In the third support member 36, the guide portions 39 and 41 are each formed of a concavity that extends in the width direction X that intersects (orthogonal in the exemplary embodiment) the transport direction F. In other words, the guide portion 39, which is arranged at a position downstream of the medium supporting section 38 in the transport direction F and upstream of the supporting projection 40 in the transport direction F, forms a concavity with respect to the medium supporting section 38 and the supporting projection 40. Furthermore, the guide portion 41, which is arranged at a position downstream of the supporting projection 40 in the transport direction F and upstream of the supporting projection 42 in the transport direction F, forms a concavity with respect to the supporting projection 40 and the supporting projection 42.

In the exemplary embodiment, the shapes of the cross-sections that are orthogonal to the width direction X of the third support member 36 do not change. Furthermore, the guide portions 39 and 41 are arranged on the center of curvature side with respect to the imaginary curve illustrated by the dot and dash line in FIG. 3.

Functions of the transporting apparatus 27 and the recording apparatus 11 configured as above will be described next.

The transport path forming unit 17 includes the guide portion 39 that is arranged downstream of the medium supporting section 38 in the transport direction F and the guide portion 41 that is arranged downstream of the supporting projection 40 in the transport direction F. Accordingly, the leading edge of the sheet S is guided by the guide portions 39 and 41 when the pair of transport rollers 29 transport the sheet S in the transport direction F.

At this time, since the guide portions 39 and 41 and the supporting projections 40 and 42 are formed with the guiding surfaces 43, 44, 45, and 46 that are continuous with each other in the transport direction F, the leading edge of the sheet S proceeds downstream in the transport direction F along the guiding surfaces 43, 44, 45, and 46 without being caught by the guide portions 39 and 41 and the supporting projections 40 and 42.

Furthermore, the transport path forming unit 17 includes the supporting projection 40 that is arranged downstream of the guide portion 39 in the transport direction F and the supporting projection 42 that is arranged downstream of the guide portion 41 in the transport direction F. Moreover, since the guide portions 39 and 41 are arranged at a position below the transport path of the sheet S, when the leading edge of the sheet S passes over the supporting projection 40, the sheet S parts from the guide portion 39 owing to the stiffness of the sheet S.

Subsequently, when the leading edge of the sheet S passes over the supporting projection 42, the sheet S parts from the guide portion 41 owing to the stiffness of the sheet S. In other words, the length of each of the guide portions 39 and 41 in the transport direction F (the distance in the transport direction F between the medium supporting section 38 and the supporting projection 40 and that between the supporting projection 40 and the supporting projection 42) is set according to the stiffness (resistance against deflection) of the sheet S.

Accordingly, the upstream portion of the sheet S in the transport direction F is supported by the medium supporting section 38 and the downstream portion of the sheet S in the transport direction F is supported by the supporting projection 40. Furthermore, the portion of the sheet S downstream of the supporting projection 40 in the transport direction F is supported by the supporting projection 42.

Moreover, the recording unit 28 is arranged between the pair of transport rollers 29 and the guide portion 39 in the transport direction F. Accordingly, the supporting projections 40 and 42 guide the printed sheet S while supporting the printed sheet S. At this time, when the sheet S becomes wet with ink and the stiffness of the sheet S is reduced causing the sheet S to be deflected between the medium supporting section 38 and the supporting projection 40 and between the supporting projection 40 and the supporting projection 42, the sheet S is subsidiarily supported by the guide portions 39 and 41. Furthermore, since the guiding surfaces 43, 45, and 46 that constitute the guide portions 39 and 41 are inclined such that the downstream side of the guiding surfaces 43, 45, and 46 in the transport direction become lower, the supported sheet S can be guided towards the downstream side in the transport direction.

Moreover, since the third support member 36 forms a transport path that becomes lower as it extends towards the downstream side in the transport direction F, the printed sheet S that is supported by the medium supporting section 38 and the supporting projections 40 and 42 hangs below the supporting projection 42 under its own weight. Accordingly, the sheet S enters a state in which an appropriate tension is applied thereto by its own weight, and thus, it is possible to transport the sheet S without any formation of wrinkles until the printing surface becomes dry.

The printed sheet S that is supported by the supporting projections 40 and 42 is wound by the winding unit 16 that is arranged below the supporting projections 40 and 42. Furthermore, the tension roller 20 presses the back side of the sheet S that hangs down under its own weight from the transport path forming unit 17.

The pressing force of the tension roller 20 is set in accordance with the length of the sheet S positioned between the apex of the supporting projection 42 and the roll R2. In other words, the supporting projection 42 is arranged such that tension is applied to the sheet S, positioned between the supporting projection 42 and the roll R2, by the weight of the sheet S and by the tension roller 20. The tension roller 20 presses the sheet S forward so that the sheet S does not become folded along the guiding surfaces 46 and 47. Accordingly, the sheet S is wound by the winding unit 16 without coming into contact with the guiding surface 47.

Now, if the guiding surface of the guide portions 39 and 41 form a bent transport path that extends along the imaginary curve indicated by a dot and dash line in FIG. 3, the sheet S will be transported while being continuously in sliding contact with the guiding surface. As a result, the sheet S is charged with static electricity due to being in sliding contact with the guiding surface and sticks to the guiding surface.

If the pair of transport rollers 29 continue to transport the sheet S in this state, as indicated by a two-dot chain line in FIG. 3, the sheet S is lifted up at a portion upstream in the transport direction of where the sheet S is stuck to the guiding surface, and, further, the lifted area spreads to the upstream side in the transport direction. Thereupon, the lifted sheet S comes into contact with the discharge opening 14*a* of the housing 14, the carriage 31, the liquid ejecting unit 32, and the like, and a concern regarding damage to the printing surface arises.

In that respect, in the exemplary embodiment, since the sheet S is supported by the supporting projections 40 and 42 that are spaced apart from each other in the transport direction F, the contact area of the sheet S with the transport path forming unit 17 is smaller and static electricity is not easily generated.

The following effects can be obtained by the exemplary embodiment described above.

(1) The guide portions 39 and 41 can guide the leading edge of the sheet S, which is being transported by the pair of transport rollers 29, in the transport direction F from the medium supporting section 38 side to the supporting projections 40 and 42 side and, further, can subsidiarily support the sheet S that has been deflected below the transport path. Since the guide portions 39 and 41 form concavities with respect to the medium supporting section 38 and the supporting projections 40 and 42, when the sheet S is supported by the medium supporting section 38 and the supporting projections 40 and 42, contact between the guide portions 39 and 41 and the sheet S is restrained. Moreover, the sheet S, whose upstream portion in the transport direction F is supported by the medium supporting section 38, hangs down under its own weight at the upstream side or the downstream side of the supporting projections 40 and 42 in the transport direction F, and thus, an appropriate tension is applied to the sheet S. Accordingly, generation of static electricity can be suppressed while an appropriate tension is applied to the sheet S that is being transported.

(2) In the sheet S that is being transported along the transport path while being supported by the medium supporting section 38 and the supporting projections 40 and 42, the portions above the concavities (guide portions 39 and 41) part from the guide portions 39 and 41. Accordingly, generation of static electricity, caused by continuous contact of the sheet S with the members that support the sheet S, can be suppressed.

(3) When the leading edge of the sheet S is transported toward the supporting projections 40 and 42 from the medium supporting section 38, the guiding surfaces 43, 44, 45, and 46 that are consecutively aligned in the transport direction F guide the leading edge, and thus, the sheet S is not easily caught by the guide portions 39 and 41. Furthermore, the configuration can be simplified by forming the guide portions 39 and 41 and the supporting projections 40 and 42 with the guiding surfaces 43, 44, 45, and 46 that are consecutively aligned in the transport direction F.

(4) Since the transport path is formed with the supporting projections 40 and 42 such that the downstream side in the transport direction F becomes lower, the portion of the sheet S, which is supported by the supporting projections 40 and 42, downstream of the supporting projection 42 in the transport direction hangs down under its own weight. Accordingly, an appropriate tension is applied to the sheet S.

(5) The sheet S is supported by the supporting projections 40 and 42 that are arranged downstream of the recording unit 28 in the transport direction; accordingly, the wrinkles of the sheet S, on which printing has been carried out, can be stretched out.

(6) The medium supporting section 38 and the supporting projections 40 and 42 can form a transport path that extends along the imaginary curve that becomes lower towards the downstream side in the transport direction. Accordingly, a portion of the sheet S, which is supported by the supporting projections 40 and 42, downstream in the transport direction hangs down under its own weight. Accordingly, an appropriate tension is applied to the sheet S. Furthermore, the sheet S can be made to adequately part from the transport path by arranging the guide portions 39 and 41 on the center of curvature side of the imaginary curve. Accordingly, when the sheet S is deflected so as to hang down between the medium supporting section 38 and the supporting projection 40, or between the supporting projection 40 and the supporting projection 42, the guide portions 39 and 41 can subsidiarily support the sheet S while guiding the sheet S toward the downstream side in the transport direction.

(7) The sheet S that is supported by the supporting projections 40 and 42 hangs down under its own weight at a portion downstream of the supporting projection 42 in the transport direction, and thus, an appropriate tension is applied to the sheet S. Accordingly, the winding unit 16 can wind the sheet S that is in a state in which the wrinkles are stretched out.

Note that the following changes can be made to the exemplary embodiment described above.

- The guide portions do not have to be concavities. For example, a guide portion may be arranged below the transport path by arranging rollers, serving as supporting projections, at a predetermined interval in the transport direction F on the flat surface or curved surface that forms the guide portion. In other words, since the guide portion is arranged at a position that deviates from the transport path, the guide portion does not normally support the sheet S. The guide portion only needs to be capable of subsidiarily supporting the sheet S that hangs down from the transport path.
- Each of the guide portions and the supporting projections does not necessarily need be formed continuously in the width direction X. For example, the guide portions may each be a plurality of concavities aligned in the width direction X with a predetermined interval therebetween, and the supporting projections may each be a plurality of projections aligned in the width direction X with a predetermined interval therebetween.
- The medium supporting section 38 may be an inclined surface.
- The guiding surface 44 may be an inclined surface, and the guiding surface 46 may be a horizontal surface.
- Each of the guide portions 39 and 41 may be a concavity formed by three of more guiding surfaces consecutively aligned in the transport direction F.
- The guide portions and the supporting projections may be formed of different members.
- The medium supporting section, the guide portions, and the supporting projections may be formed of a single member.
- The transporting apparatus 27 may include three or more supporting projections aligned so as to be spaced apart in the transport direction F. Alternatively, the transporting apparatus 27 may include a single guide portion and a single supporting projection that is arranged downstream of the single guide portion in the transport direction.
- The medium supporting section and the supporting projections may be arranged along a transport path that is formed so that the downstream side in the transport direction F is higher. For example, the medium supporting section, the supporting projections, and the guide portions may be formed in the first support member 34.
- The medium supporting section and the supporting projections may be arranged along a transport path that extends in the horizontal direction. In this case as well, an appropriate tension can be applied to the sheet S by making the sheet S hang down upstream of the medium supporting section in the transport direction or downstream of the supporting projections in the transport direction.
- The end portion of the medium supporting section 38 downstream in the transport direction F and the apexes of the supporting projections 40 and 42 may be arranged along a predetermined imaginary straight line.
- The tension applying mechanism 18 may not be provided and the winding unit 16 may wind the sheet S, which hangs down from the transport path forming unit 17 under the weight of the sheet S itself.
- The winding unit 16 may not be provided and the sheet S may be discharged without being wound.
- Not limited to a recording apparatus, the transporting apparatus 27 may be provided to any device that transports a medium, such as a device that performs processing of a medium, a device that unwinds and winds a medium, or the like.
- The recording apparatus is not limited to a serial printer that includes a carriage 31 that travels in the main scanning direction, but may be a full-line head type line printer that is provided with a liquid ejecting unit 32 across the whole width in the width direction X.
- The recording apparatus is not limited to a liquid ejecting device that ejects liquid and may be a printing device such as an electrophotographic laser printer that uses electrostatic force to deposit minute particles such as toner on a medium, a thermal transfer printer (including a sublimation printer), or a dot impact printer.
- In the exemplary embodiment described above, the recording apparatus may be a fluid ejecting device that performs recording by ejecting or discharging a fluid other than ink such as a liquid, a liquid substance containing particles of functional material dispersed or mixed in liquid, or a fluid body such as a gel, as well as solids that can be made to flow and be ejected as a fluid. For example, the recording apparatus may be a liquid substance ejecting device that performs recording by ejecting a liquid substance including, in a dispersed or dissolved manner, a material, such as electrode material or a color material (a pixel material), that is used to manufacture liquid crystal displays, electroluminescence (EL) displays, and surface-emitting displays. Furthermore, the recording apparatus may be a fluid body ejecting device that ejects a fluid body such as a gel (a physical gel, for example), or a particulate matter ejecting device (a toner jet recording apparatus, for example) that ejects solids, for example, a powder (particulate matter) such as a toner. Moreover, the present invention can be applied to either one of the types of the fluid ejecting devices. Note that in the present specification, "fluid" is a concept that excludes fluids containing gas alone, and the meaning of fluid includes, for example, a liquid (including an inorganic solvent, an organic solvent, solution, a liquid resin, a liquid metal (metal melt), and the like), a liquid substance, a fluid body, and a powder (including particulate matter).

The entire disclosure of Japanese Patent Application No. 2012-248364, filed Nov. 12, 2012 is expressly incorporated by reference herein.

What is claimed is:

1. A transporting apparatus, comprising:

a transporting unit that transports a medium along a transport path that extends in a transport direction;

a medium supporting section that supports the medium at a portion downstream of the transporting unit in the transport direction;

a first supporting projection that supports the medium at a portion downstream of the medium supporting section in the transport direction;

a second supporting projection that supports the medium at a portion downstream of the first supporting projection in the transport direction; and a guide portion that is arranged at a position downstream of the medium supporting section in the transport direction and upstream of the first supporting projection in the transport direction, the guide portion forming a first concavity in the transport path with respect to the medium supporting section and the first supporting projection and a second concavity in the transport path with respect to the first supporting projection and the second supporting projection, the first and second concavities being consecutively aligned in the transport direction, wherein a portion of the medium located between the medium supporting section and the second supporting projection is located above the guide portion such that the medium does not contact any surface of the guide portion to thereby suppress static electricity.

2. The transporting apparatus according to claim 1, wherein the first and second concavities extend in a width direction that intersects the transport direction.

3. The transporting apparatus according to claim 1, wherein the first and second supporting projections are arranged below the medium supporting section.

4. The transporting apparatus according to claim 1, wherein a recording unit that performs recording on the medium is arranged between the transporting unit and the guide portion in the transport direction.

5. The transporting apparatus according to claim 1, wherein an end portion of the medium supporting section downstream in the transport direction, the first supporting projection, and the second supporting projection are arranged along an imaginary curve that has a center of curvature below the medium supporting section, and the guide portion is arranged on the center of curvature side of the imaginary curve.

6. The transporting apparatus according to claim 1, further comprising a winding unit that is arranged below the second supporting projection and that winds the medium supported by the medium supporting section and the second supporting projection.

7. A recording apparatus, comprising:

the transporting apparatus according to claim 1; and a recording unit that performs recording on the medium that is transported by the transporting apparatus.

8. A recording apparatus, comprising:

the transporting apparatus according to claim 2; and a recording unit that performs recording on the medium that is transported by the transporting apparatus.

9. A recording apparatus, comprising:

the transporting apparatus according to claim 3; and a recording unit that performs recording on the medium that is transported by the transporting apparatus.

10. A recording apparatus, comprising:

the transporting apparatus according to claim 4; and a recording unit that performs recording on the medium that is transported by the transporting apparatus.

11. A recording apparatus, comprising:

the transporting apparatus according to claim 5; and a recording unit that performs recording on the medium that is transported by the transporting apparatus.

12. A recording apparatus, comprising:

the transporting apparatus according to claim 6; and a recording unit that performs recording on the medium that is transported by the transporting apparatus.

* * * * *